US007584879B2

(12) United States Patent
Blessing et al.

(10) Patent No.: US 7,584,879 B2
(45) Date of Patent: Sep. 8, 2009

(54) POSITIONING DEVICE FOR A HAND-HELD SETTING TOOL AND HAVING SWITCHING MEANS FOR ACTUATING THE ACTUATION SWITCH OF THE SETTING TOOL

(75) Inventors: Matthias Blessing, Frastanz (AT); Markus Sprenger, Mauren (LI)

(73) Assignee: Hilti Aktiengesellschaft, Schaan (LI)

( * ) Notice: Subject to any disclaimer, the term of this patent is extended or adjusted under 35 U.S.C. 154(b) by 15 days.

(21) Appl. No.: 11/904,533

(22) Filed: Sep. 26, 2007

(65) Prior Publication Data

US 2008/0029567 A1 Feb. 7, 2008

(30) Foreign Application Priority Data

Oct. 2, 2006 (DE) ..... 10 2006 000 497

(51) Int. Cl.
*B25C 7/00* (2006.01)
*B25C 1/00* (2006.01)

(52) U.S. Cl. ..... 227/129; 227/8; 227/147; 227/156

(58) Field of Classification Search ..... 227/8, 227/9, 10, 110, 147, 129, 130, 131, 132, 227/133, 156

See application file for complete search history.

(56) References Cited

U.S. PATENT DOCUMENTS 2,679,645 A * 6/1954 Bullwinkle et al. ..... 227/11
2,716,813 A * 9/1955 Smyres ..... 30/228
3,235,154 A * 2/1966 Mulno ..... 227/10
3,310,215 A * 3/1967 Bostick ..... 227/111
3,482,753 A * 12/1969 Bayer et al. ..... 227/10
3,682,364 A * 8/1972 Maier ..... 227/9
3,797,721 A * 3/1974 Clumb ..... 227/9
3,805,472 A * 4/1974 Helderman ..... 52/745.21
3,977,088 A * 8/1976 Bondi ..... 33/334
4,068,790 A * 1/1978 Osterle et al. ..... 227/8
4,153,193 A * 5/1979 Urbanowicz ..... 227/156
4,403,892 A * 9/1983 Kane ..... 408/95
4,479,599 A * 10/1984 Conrad ..... 227/9
4,655,380 A * 4/1987 Haytayan ..... 227/9
4,736,804 A * 4/1988 Geibel ..... 173/30
4,830,254 A * 5/1989 Hsu ..... 227/10
5,016,802 A * 5/1991 Haytayan ..... 227/11
5,273,198 A * 12/1993 Popovich et al. ..... 227/10
5,363,736 A * 11/1994 Huang ..... 89/1.14
5,465,893 A * 11/1995 Thompson ..... 227/8
5,497,929 A * 3/1996 Armstrong ..... 227/9
5,518,161 A * 5/1996 Thompson ..... 227/8
5,715,983 A * 2/1998 Lee ..... 227/9

(Continued)

*Primary Examiner*—Paul R Durand
(74) *Attorney, Agent, or Firm*—Ableman, Frayne & Schwab

(57) ABSTRACT

A positioning device for a hand-held setting tool (10) includes a holder (21), a support (22) for the setting tool (10) arranged at an end of the holder and fixedly connected with an elongate support element (23) extending parallel to the longitudinal axis (A) defined by the holder and having, at its end remote from the support, a base part, and a switching device for actuating the actuation switch (13) of the setting tool (10) and including an operating element for actuating the actuation switch (13), and an actuation element (24) arranged radially outwardly of the support element (23) and displaceable axially thereto and connectable with the operating element, with the base part extending beyond the end of the actuation element (24) remote from the support (22).

4 Claims, 3 Drawing Sheets

U.S. PATENT DOCUMENTS 5,992,723 A * 11/1999 Lee ..... 227/9
6,547,165 B2 * 4/2003 Goodwin et al. ..... 239/532
7,121,598 B2 * 10/2006 Pourtier et al. ..... 294/19.1
2004/0149801 A1 * 8/2004 Hirtl et al. ..... 227/10
2008/0029567 A1 * 2/2008 Blessing et al. ..... 227/10

* cited by examiner

POSITIONING DEVICE FOR A HAND-HELD SETTING TOOL AND HAVING SWITCHING MEANS FOR ACTUATING THE ACTUATION SWITCH OF THE SETTING TOOL

BACKGROUND OF THE INVENTION

1. Field of the Invention

The present invention relates to a positioning device for a hand-held setting tool having an actuation switch for actuating the setting tool, with the positioning device including a holder defining a longitudinal axis, a support for the setting tool arranged at an end of the holder, and operating means for actuating the actuation switch of the setting tool and which is actuated by the holder.

2. Description of the Prior Art

Positioning devices of the type described above are used, e.g., at overhead works with hand-held setting tools in case of high ceilings when working is possible only using working platforms or ladders. Setting tools, which can be used with such devices, can be driven with solid, gaseous, or liquid fuels or with compressed air or electricity.

U.S. Pat. No. 4,479,599 discloses a positioning and actuation device for a combustion-operated setting tool and including a support for the setting tool, which is arranged at an end of an elongated holder in form of a rod or a bar. The rod or bar is axially displaceable relative to the support for actuating the actuation switch of the setting tool, which is received in the support, via coupling means. For actuating the setting tool, the tool should be placed with its muzzle piece against a ceiling and then be displaced in the direction of the ceiling with the holder or rod by the user.

The drawback of this positioning device consists in that the setting tool, which is arranged in the support, can also be actuated when the positioning and actuating device is supported with the rod or bar on a bottom (floor), and the user manually presses the rod against the muzzle piece of the setting tool.

An object of the present invention is a positioning device with actuating switching means in which the drawback of a known positioning and actuating device is eliminated.

SUMMARY OF THE INVENTION

This and other objects of the present invention, which will become apparent hereinafter, are achieved by providing a positioning device for a hand-held setting tool having an actuation switch for actuating the setting tool of the type discussed above and in which the holder has an elongate support element extending parallel to the longitudinal axis and connected, directly or indirectly, with the support.

The actuating switching means for actuating the actuation switch of setting tool includes operating means for actuating the actuation switch, and an actuation element arranged radially outwardly of the support element and displaceable axially thereto and connectable with the operating means. The support element has, at its end remote from the support, a base part extending beyond an axial end for the actuation element remote from the support.

With the positioning device according to the present invention, an inadvertent actuation of the setting tool, which is arranged in the support, is reliably prevented when the positioning device is supported with the base part on the bottom, and the device is manually pressed against the muzzle piece of the setting tool. This is because the actuation element remains unactuated.

Advantageously, the base part is formed as a pot-shaped part that receives and overlaps the remote axial end of the actuation element. Thereby, penetration of dirt in the space between the base part and the actuation element is prevented, and inadvertent actuation of the actuation element, upon pressing of the positioning device with the base part against the bottom, is prevented, independent from its nature.

According to a technically advantageous embodiment of the present invention, the operating means has a first switching member axially displaceable in the holder and connectable with the actuation element. As a result, the connection point is not accessible from outside and is protected.

It is advantageous when the holder has a connection element fixedly secured to the support element, and a counter-connection element connectable with the connection element, and the first switching member is displaceable in the connection member, and the operating means further has a second switching member associated with the counter-connection element and cooperating with the first switching member. The foregoing features permit to form the positioning device of two or more connectable parts or modules and which enables to transmit the actuation movement of the actuation element to the support and to the setting tool supported therein.

If the counter-connection element is connected with the support, the second switching member can cooperate with a switching link and a driver provided on the support for actuating the actuation switch of the setting tool and connectable with the switching link. Thereby in a technically simple way, the positioning device can be formed of two parts or modules.

A robust and cost-effectively manufactured positioning device is obtained when the support element is formed as a bar, and the actuation element has formed an actuation sleeve arranged coaxially with the bar-shaped support element.

The novel features of the present invention, which are considered as characteristic for the invention, are set forth in the appended claims. The invention itself, however, both as to its construction and its mode of operation, together with additional advantages and objects thereof, will be best understood from the following detailed description of the preferred embodiment, when read with reference to the accompanying drawings.

DETAILED DESCRIPTION OF THE PREFERRED EMBODIMENTS

Figure 1:
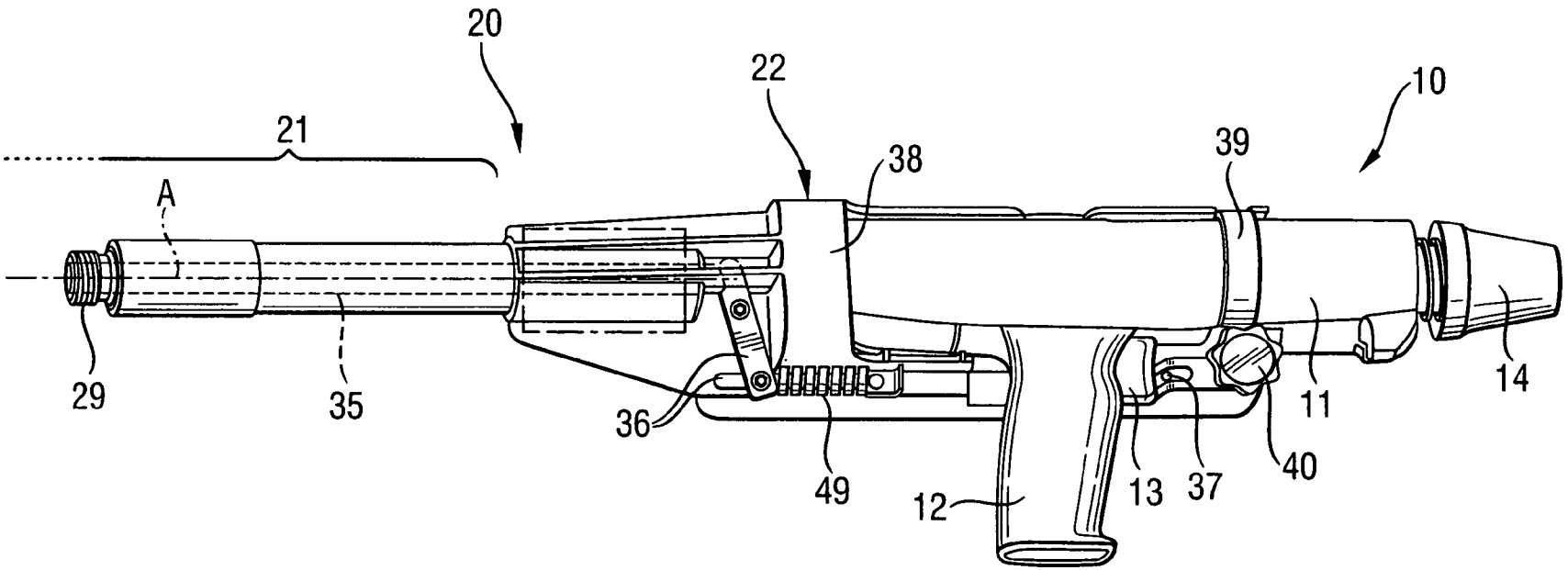
FIG. 1 a side view of a first part of a positioning device according to the present invention and including an actuation switching means and a support in which a hand-held setting tool is arranged, with the setting tool in a non-press-on position.
Figure 2:
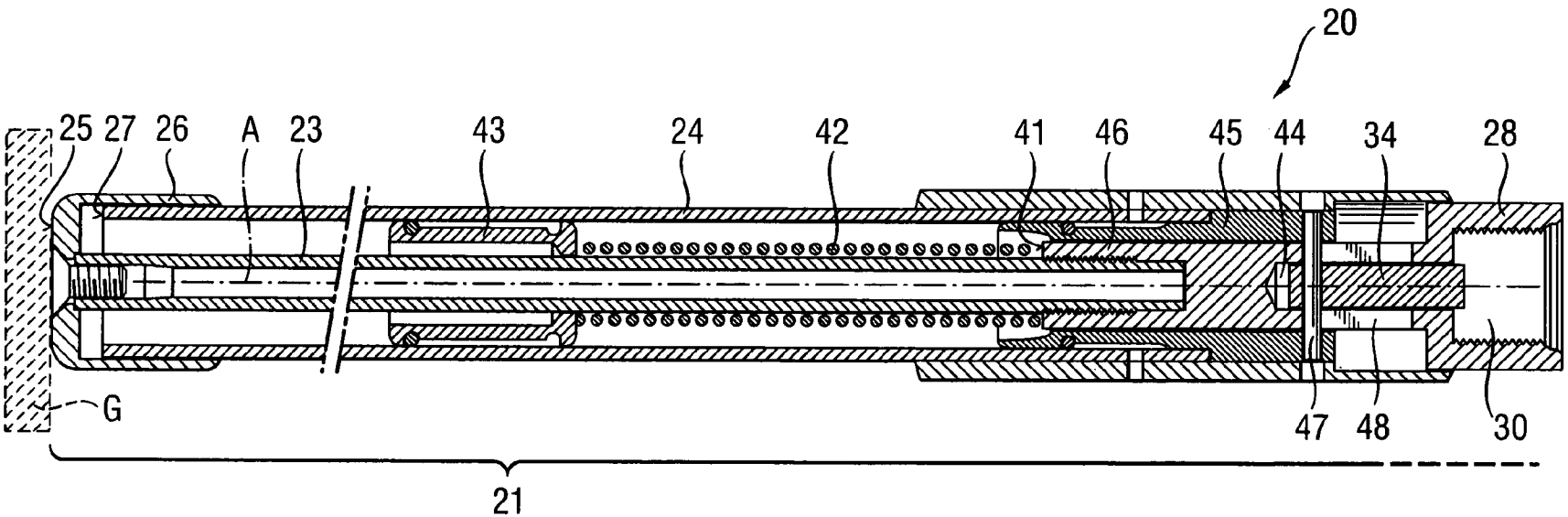
FIG. 2 a longitudinal cross-sectional view of a second part of the positioning device according to the present invention with the actuation switching means in a non-actuated position.
Figure 3:
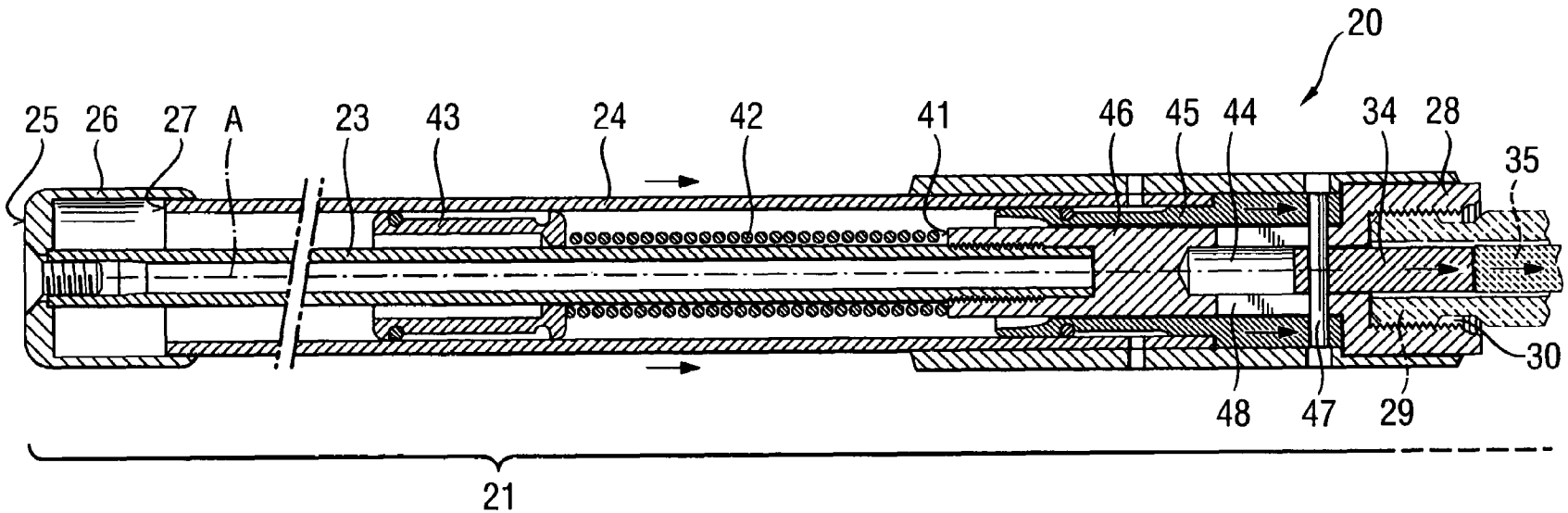
FIG. 3 a longitudinal cross-sectional view of a second part of the positioning device according to the present invention with the actuation switching means in an actuated position.

FIGS. 1-3 show a positioning device 20 according to the present invention for a hand-held setting tool 10 and having actuation switching means. The inventive positioning device 20 can be formed, e.g., as a modular unit. In an assembled position, the positioning device 20 is formed of a first part of a rod-like holder 21 shown in FIGS. 2 and 3, and a second part of the holder 21 shown in FIG. 1 and having, respectively, a coupling element 28 (FIGS. 2, 3) and a counter-coupling element 29 (FIG. 1) connected with each other, as shown with dash lines in FIG. 3. The longitudinal extension of the rod-like holder 21 defines a longitudinal axis A of the positioning device 20.

A setting tool 10, which is shown in FIG. 1, includes a one- or multi-part housing 11 in which a setting mechanism for driving fastening elements in a constructional component is arranged. For actuation of the setting tool 10, an actuation switch 13 is provided on the handle 12 of the setting tool 10. The setting tool 10 further includes a muzzle part 14 arranged in front of the housing 11 and displaceable relative to the housing. When the setting tool 10 is pressed with the muzzle part 14 against a constructional component (not shown in the drawings), the setting tool 10 assumes a setting-ready position in which the setting tool 10 can be actuated with the actuation switch 13. The actuation switching means of the positioning device 20 includes an actuation element 24 and operating means that connects the actuation element 24 with the actuation switch 13 of the setting tool 10. Thus, the actuation element 24 functions as a remote actuation switch.

As shown in FIG. 1, the hand-held power tool 10 is arranged on a support 22 of the positioning device 20 and is releasably secured with holding elements 38, 39. The setting tool 10 can be taken off the support 22 by releasing screw means 40 of the second holding element 39.

FIGS. 2-3 show a first part of the holder 21 and which forms part of the positioning device 20. The first part, which is shown in FIGS. 2-3, includes the actuation element 24 that is formed as an elongate actuation sleeve displaceable along a support element 23 formed as a hollow bar. The actuation element 24 is displaceable relative to the support element 23 parallel to the longitudinal axis A of the positioning device 20. At an end 25 of the support element 23 remote from the support 22 for the setting tool 10, there is provided a base part 26 that extends beyond an axial end 27 of the actuation element 24 remote from the support 22.

The support element 23 is fixedly connected with a connection element 28 having, at its end remote from the support element 23, a receptacle 30 for the counter-connecting element 29. At an end of the connecting element 28 adjacent to the base part 26, a support point 41 for a spring 42 is formed. At its other end, the spring 42 is supported against the actuation element 24 via an intermediate element 43 that is formed as an inner sleeve. The spring 42 biases the actuation element 24 in a direction of its initial position shown in FIG. 2. The intermediate element 43 is fixedly connected with the actuation element 24.

The actuation element 24 cooperates with a first switching member 34 of the operating means and which is formed as a pin displaceable in a guide 44 formed as a blind bore in the connection element 28. In the embodiment shown in the drawings, the actuation element 24 is connected with a sleeve-shaped end piece 45 that at least partially surrounds a region 46 of the connection element 28 adjacent to the support element 23. The end piece 45 is connected with the first switching member 34 by a connecting element 47 which is formed as a pin and extends transverse to the longitudinal axis A of the positioning device 20. The connecting element 47 extends through slot-shaped openings 48 provided in the region 46 of the connection element 28. The slot-shaped openings 48 enable displacement of the connecting element 27 relative to the connection element 28 in a direction parallel to the longitudinal axis A.

The second part of the holder 21, together with the support 22 arranged thereon, which forms part of the positioning device 20, is shown in FIG. 1. At its end remote from the support 22, the second part of the holder 21 carries the circular counter-connection element 29 that, as discussed previously, is inserted in the receptacle 30 in the connection element 28 (see FIG. 3). Thereby, the connection elements 28, 29 form a releasable connection, and the positioning device 20 can be easily assembled and disassembled.

The operating means includes a second switching member 35 that cooperates with a first switching member 34 when the connection element 28 and the counter-connection element 29 are connected with each other. The second switching member 35 is formed as a rod-shaped part displaceable in an inner bore of the second part of the holder 21. In the transitional region from the holder 21 to the support 22, the second switching member 35 is displaceably connected by a switching link 36 with the support 22 for displacement relative to the support 22 at least in one direction. The switching link 36 also forms part of the operating means. At the free end of the switching link 36, there is provided a driver 37 that cooperates with the actuation switch 13 of the setting tool 10 which is supported in the support 22. A spring 49 biases the switching link 36, together with the driver 37 in a non-actuated position shown in FIG. 1 and in which the driver 37 does not apply pressure to the actuation switch 13 of the setting tool 10.

In the initial position of the positioning device 20 shown in FIG. 2, the spring 42 biases the actuation element 24 as far as possible in the pot-shaped base part 26. The first switching member 34 is likewise displaced in the guide 44 in the connection element 28 as far as possible (see FIG. 1). When the base part 26 is supported against a stationary object G, shown in FIG. 2 with dash lines, an actuation of the setting tool 10 in the support 22 of the positioning device 20 by mere application of pressure to the muzzle part 14 of the setting tool 10 is not possible, as the actuation element cannot be actuated. The press-on force is transmitted, in this case, via the base part 26 and the support element 23 directly to the connection element 28.

In FIG. 3, the setting tool 10 is pressed with its muzzle part against a ceiling or a workpiece, not shown in the drawings, and the actuation element 24 is displaced against the biasing force of the spring 42 in the direction of the connection element 28 manually by the user. The end piece 45 is displaced, together with the actuation element 24, and the movement of the end piece 45 is transmitted to the connecting element 47 and thereby to the first switching member 34 that actuates the second switching member 35. The second switching member 35 displaces the switching link 36 and the driver 37 that actuates the actuation switch 13 of the setting tool 10, initiating a setting process.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A positioning device for a hand-held setting tool (10) having an actuation switch (13) for actuating the setting tool (10), the positioning device comprising a holder (21) defining a longitudinal axis (A); a support (22) for the setting tool (10) arranged at an end of the holder (21), the holder (21) having an elongate support element (23) extending parallel to the longitudinal axis (A) and fixedly connected with the support (22) at one end thereof and having base part (26) at an opposite end thereof remote from the support (22); and switching means for actuating the actuation switch (13) of the setting tool (10) and including operating means for actuating the actuation switch (13), and an actuation element (24) arranged radially outwardly of the support element (23) and displaceable axially thereto and connectable with the operating means, the base part (26) extending beyond an axial end (27) of the actuation element (24) remote from the support (22), wherein the operating means comprises a first switching member (34) axially displaceable in the holder (21) and connectable with the actuation element (24), and wherein the holder (21) has a connection element (28) fixedly secured to the support element (23), and a counter-connection element (29) connectable with the connection element (28), wherein the first switching member (34) is displaceable in the connection member (28), and wherein the operating means comprises a second switching member (35) associated with the counter-connection element (29) and cooperating with the first switching member (34).

2. A positioning device according to claim 1, wherein the base part (26) is formed as a pot-shaped part that receives and overlaps the remote axial end (27) of the actuation element (24).

3. A positioning device according to claim 1, wherein the operating means further comprises a switching link (36) and a driver (37) provided on the support (22) for actuating the actuation switch (13) of the setting tool (10) and connectable with the switching link (36), and wherein the counter-connection element (29) is connected with the support (22), whereby the second switching member (35) is capable to cooperate with the switching link (36) and the driver (37).

4. A positioning device according to claim 1, wherein the support element (23) is formed as a bar, and the actuation element (24) is formed as an actuation sleeve arranged coaxially with the bar-shaped support element (23).

* * * * *